United States Patent [19]

Barnes

[11] Patent Number: 4,718,677

[45] Date of Patent: Jan. 12, 1988

[54] THROW AND CATCH GAME

[76] Inventor: Earl E. Barnes, 1550 S. 12th St., Aransas Pass, Tex. 78336

[21] Appl. No.: 795,210

[22] Filed: Nov. 5, 1985

[51] Int. Cl.[4] ..... A63B 67/00

[52] U.S. Cl. ..... 273/412; 273/346; 273/DIG. 30

[58] Field of Search ..... 273/412, 414, 323, 344, 273/345, 346, DIG. 30; 128/DIG. 15

[56] References Cited

U.S. PATENT DOCUMENTS 2,930,618 3/1960 Glintz ..... 273/323
3,927,881 12/1975 Lemelson et al. ..... 273/346 X
3,953,030 4/1976 Munchnick ..... 273/346
3,999,748 12/1976 Clarke ..... 273/346
4,017,076 4/1977 Bai ..... 273/346
4,029,316 6/1977 Clarke ..... 273/346 X
4,240,639 12/1980 Bolton et al. ..... 273/346

*Primary Examiner*—William H. Grieb
*Attorney, Agent, or Firm*—Cox & Smith, Inc.

[57] ABSTRACT

The invention is a throw and catch game in which the projectile is covered with a Velcro TM material and the receivers for catching the projectile are placed on the elbows or knees of a person so that the projectile will stick to the receivers when they are in contact.

6 Claims, 3 Drawing Figures

THROW AND CATCH GAME

BACKGROUND OF THE INVENTION

The present invention relates to a throw and catch game. More particularly, the present invention relates to a game in which a projectile is covered with a bonding material and is thrown to a receiver which engages the bonding material and holds it, the receiver being adaptable to be held on the limb of a human at a position above the hands or feet.

Throw and catch games, although very old in the art, are constantly evolving and changing because of changes in materials and technology. For example, the permutations in styles of play and the objects of a throw and catch game differ greatly when comparing a simple baseball game with a frisbee game, the frisbee being made possible by advances in light weight and durable plastics.

More recently, other advances and materials have produced Nerf TM balls having peculiar characteristics which make them attractive as throw and catch toys. Also, the invention of Velcro TM has made possible a throw and catch game in which the receiving player does not actually have to grasp the projectile with his hand or glove. Examples of such projectiles are shown in U.S. Pat. Nos. 4,240,639, 4,029,316 and 3,927,881. Receiving devices to which the projectiles stick are shown in U.S. Pat. Nos. 4,017,076 and 3,953,030. However, both devices only disclose receivers which fit over the hand of the receiving player.

U.S. Pat. No. 3,953,030, issued to Muchnick, discloses a Velcro TM covered ball and a Velcro TM lined glove for particular use by young children and mentally or physically handicapped people to allow them to play a throw and catch game without requiring substantial muscular coordination or finger movement in the hand.

U.S. Pat. No. 4,017,076, issued to Bai, discloses a more sophisticated throw and catch game in which a dart board type target is placed over the hand and a Velcro TM covered ball is thrown so that it sticks on the target and points are scored depending where it is caught on the target.

What has not been recognized in the prior art is that a more sophisticated and challenging throw and catch game may be created by placing the receiver on a part of the body other than the hand. The ability to catch the projectile without using the hands is made possible by advances in materials such as Velcro TM.

It is anticipated that placing the receiver on the elbows or knees would create a more challenging game of throw and catch, because the limited mobility and coordination of these parts of the body when compared to the hands makes it more difficult to catch the thrown object.

Therefore, it is an object of the present invention to provide a throw and catch game in which the projectile can be caught without using the hands.

Further, it is an object of the present invention to provide a throw and catch game in which the receiver will cause the projectile to stick to it, and will be placed on parts of the body other than the hands.

Further, it is an object of the present invention to provide a more challenging and difficult throw and catch game.

These and other objects of the present invention are obvious, or will become so, during the description of the preferred embodiment.

SUMMARY OF THE INVENTION

A throw and catch game comprising a projectile for throwing from a first player to a receiving player, the projectile at least partially covered with a bonding material, at least one receiver for receiving and holding the projectile, the receiver at least partially covered with a bonding material and adaptable to be held on the limb of a human at a position intermediate to the extremes of the limb. The bonding material may be comprised of a plurality of resilient fibers attached to a backing, such that when the bonding material is pressed against another bonding material the fibers intertwine and are releasably held together. The bonding material may be Velcro. The projectile may be substantially spherical with the bonding material relatively uniformly distributed over the surface of the projectile. The receiver may be comprised of a substantially tubular elastic material adapted to fit the knee or elbow area of a limb of a person.

DESCRIPTION OF THE PREFERRED EMBODIMENT

Figure 2:
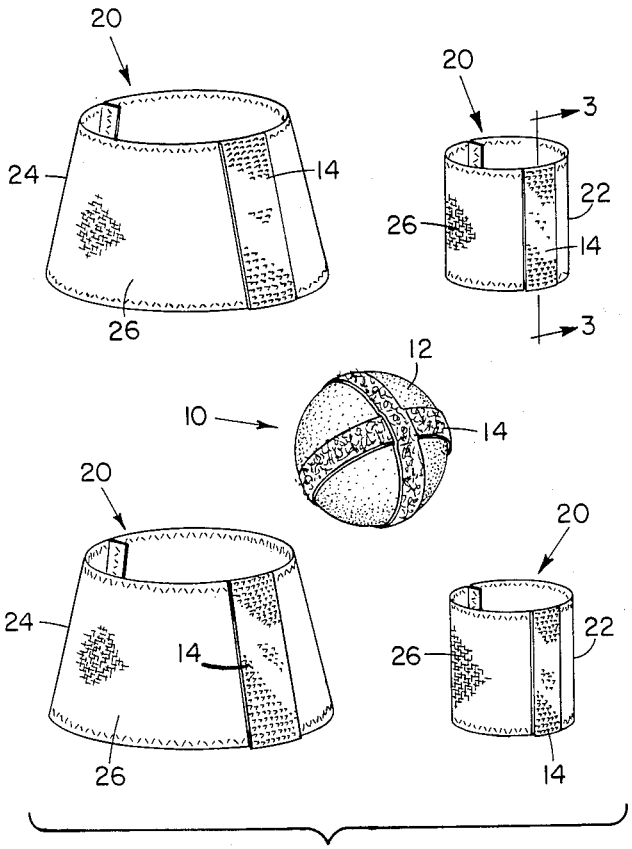
FIG. 2 is a side perspective view of the projectile and receivers.

In FIG. 2 is shown the preferred embodiment of the projectile and receivers used in the game. The projectile 10 is, in the preferred embodiment, comprised of a spherical core 12 partially covered by bonding material 14. The core 12 is made of a foam substance, although other materials of various resiliencies may be used, depending on the flight characteristics of the projectile 10 desired and other considerations. The core 12 is relatively uniformly covered by the bonding material 14. The bonding material 14 is adhered to the core 12 by glue or other methods known in the art. The bonding material 14 is substantially uniform in coverage to keep the weight of the projectile 10 evenly distributed, and because the projectile 10 should have a relatively uniform chance of sticking to the receivers anywhere on the projectiles 10 surface. Thus, the bonding material 14 could also cover the projectile 10 completely. Further, other bonding materials 14 beside Velcro may be used, as long as they contain the characteristic of being able to stick to a receiver 20 while in mid-flight.

Figure 1:
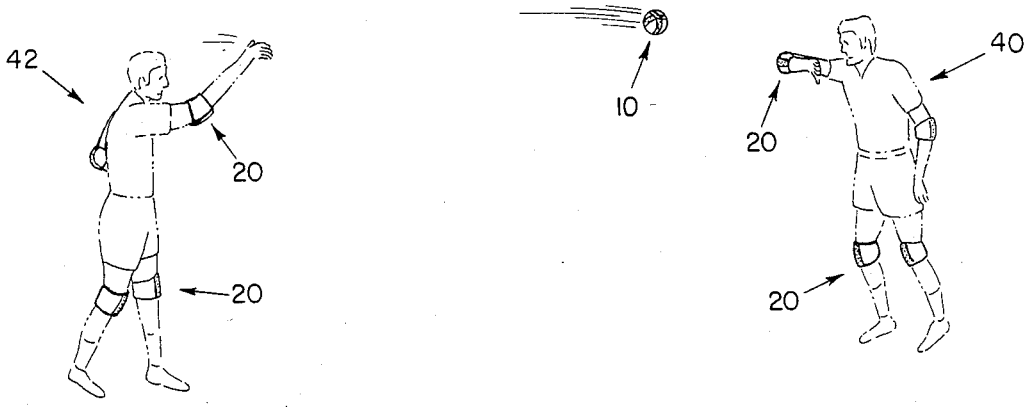
FIG. 1 is a perspective view of the game being played by two people.

The receiver 20 may take a variety of forms. In the preferred embodiment, two types of receivers 20 are used. First, an arm receiver 22 is specially adapted to fit over the arms of a person, as is the leg receiver 24 although the leg receiver 24 may vary in design to fit over different areas of the legs. The receivers 20 are generally comprised of a limb engaging means 26 again covered by a bonding material 14. In the preferred embodiment, the limb engaging means 26 is comprised of a substantially tubular elastic material such as Ponte DeRoma TM, a 100% polyester fabric. The limb engaging means 26 would be slipped over the arms or legs of a person and the elastic characteristics of the material would hold the receiver 20 relatively fixed. Again, the bonding material 14 is relatively uniformly distributed over the exterior of the limb engaging means 26. The embodiment in FIG. 2 shows a stripe of bonding material 14 on one side of the limb engaging means 26. The stripe of bonding material 14 is placed on the side of the knee and elbow facing away from the front of the player, as shown in FIG. 1.

The size and shape of the limb engaging means 26 varies with a smaller amount of material needed for the arm receiver 22 than for the leg receiver 24. Also, the circumference of the limb engaging means 26 need not be uniform, because the circumference of the leg and arm are not uniform in the areas of the knee and elbow, and the limb engaging means 26 are manufactured accordingly.

Figure 3:
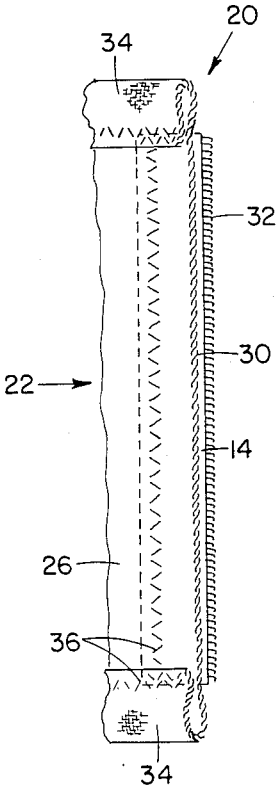
FIG. 3 is a cross-sectional view of one of the receivers taken along lines 3—3 of FIG. 2.

In FIG. 3 is shown in greater detail the construction of a particular receiver 20. When the bonding material 14 is Velcro, this material is traditionally manufactured with a base material 30 with a plurality of small resilient fibers 32 integrally formed with the base 30. The resilient fiber 32 may be hook shaped or may form small resilient loops. In either case, they are formed and are spaced so that when the bonding material 14 is placed against another bonding material 14, the resilient fibers 32 tend to intertwine and are releasably held together. The resiliency of the fibers 32 determines how easily they intertwine, and can be varied by means of manufacturing known in the art so that the bonding material 14 bonds to another strip of bonding material 14 with a relatively small force applied, as with a thrown projectile 10, but holds the projectile 10 to keep it from falling off of a receiver 20. Other designs of Velcro are known in the art, in which the resilient fibers 32 covering the bonding material 14 of the projectile 10 are different in design from the resilient fibers 32 of the bonding material 14 of the receiver 20, with one bonding material 14 being of a felt-like material while the other contains a number of small hooks. However, the term "bonding material" 14, as used here, is intended to generically cover that type of Velcro TM using male and female materials.

FIG. 3 also shows more detail as to the limb engaging means 26. As stated, the preferred embodiment uses a material such as 100% polyester for the limb engaging means 26 because of its elasticity, flexibility and comfort. The outer edges of this material are doubled back to form a collar 34 and stitched along the edge by stitching 36. Not only does the collar 34 keep the material from unraveling, it generally keeps the receiver 20 from slipping up or down the leg or arm of a person. Of course, a variety of designs for the receivers 20 would be feasible, as long as they hold the receiver 20 fairly firmly in place and are able to catch and hold the projectile 10.

The game as it is being played is shown in FIG. 1. A first player 40 throws the projectile 10 either towards the second player 42 or up in the air. If the first player 40 is playing by himself, it may be desired to throw the projectile 10 up in the air and catch it as it falls. If being thrown to a second player 42, of course, the second player 42 would catch the projecile 10. Receivers 20 are placed at the elbows and knees of the players 40 and 42. As mentioned, because of the lower mobility of the knees and elbows of a person, it is expected that the game would be more challenging than traditional throw and catch games. For example, if the projectile were thrown at a high level, but the player decided to attempt a catch with the leg receivers 24, then an acrobatic move such as a jump or cartwheel might be necessary to raise the knees high enough to catch the projectile 10. Similar difficult moves would be required to catch a projectile 10 by the arm receivers 22, if the projectile 10 is thrown relatively close to the ground.

Although the invention has been described in the above preferred embodiment, it is understood that other embodiments and designs are feasible. To the extent the invention is limited in scope, it is done so only by the following claims which are read in light of the remainder of the specification.

I claim:

1. A throw and catch game comprising:

a projectile for throwing from a first player to a receiving player, said projectile at least partially covered with a bonding material;

at least one receiver for receiving and engaging the projectile, said receiver at least partially covered with said bonding material and adaptable to be held on the limb of a human at a position intermediate to the extremities of said limb;

said receiver is comprised of an elastic sleeve adapted to fit the knee area of said limb, said sleeve being of sufficient length to cover from one side of the knee joint to the other.

2. The game as set forth in claim 1 wherein:

said bonding material is Velcro.

3. The game as set forth in claim 1 wherein:

said projectile is substantially spherical, and said bonding material is relatively uniformly distributed over the surface of said projectile.

4. A throw and catch game comprising:

a projectile for throwing from a first player to a receiving player, said projectile at least partially covered with a bonding material;

at least one receiver for receiving and engaging a projectile, said receiver at least partially covered with said bonding material and adaptable to be held on the limb of a human at a position intermediate to the extremities of said limb;

said receiver is comprised of an elastic sleeve adapted to fit the elbow area of said limb, said sleeve being of sufficient length to cover from one side of the elbow joint to the other.

5. The game as set forth in claim 4 wherein:

said bonding material is Velcro.

6. The game as set forth in claim 4 wherein:

said projectile is substantially spherical, and said bonding material is relatively uniformly distributed over the surface of said projectile.

* * * * *